United States Patent [19]

Hopkins

[11] Patent Number: 4,866,975

[45] Date of Patent: Sep. 19, 1989

[54] DIE POSITIONING MECHANISM

[75] Inventor: Reginald Hopkins, St. Catharines, Canada

[73] Assignee: Deere & Company, Moline, Ill.

[21] Appl. No.: 221,961

[22] Filed: Jul. 8, 1988

[51] Int. Cl.[4] ..... B21J 13/03

[52] U.S. Cl. ..... 72/448; 72/446; 72/389; 72/477; 72/482

[58] Field of Search ..... 72/389, 446, 448, 477, 72/482, 481, 415

[56] References Cited

U.S. PATENT DOCUMENTS

| | | | |
|---|---|---|---|
| 2,456,749 | 12/1948 | Steibel | 72/448 |
| 2,762,414 | 9/1956 | Demler | 72/448 |
| 3,029,858 | 4/1962 | Harper | 72/448 |
| 4,443,928 | 4/1984 | Kielma | 72/446 |
| 4,672,835 | 6/1987 | Liet | 72/389 |

FOREIGN PATENT DOCUMENTS

| | | | |
|---|---|---|---|
| 0354146 | 6/1922 | Fed. Rep. of Germany | 72/389 |
| 1163931 | 10/1958 | France | 72/389 |

*Primary Examiner*—David Jones

[57] ABSTRACT

There is disclosed a die repositioning mechanism useful for repositioning dies on the bed of a power operated press. It is particularly useful in preventing unwanted rotation of elongated non-symmetrical dies as they are lifted from the press bed. The mechanism includes a torque limiter carried at each end of the elongated die and a C-hook for connecting the die to the press ram in order to lift the die with the upstroke with the ram of the press. Adjustment of the torque limiter to retard or prevent rotation of the elongated die as it is lifted permits a single person to safely reposition the desired working face of the die on the press bed.

6 Claims, 2 Drawing Sheets

DIE POSITIONING MECHANISM

FIELD OF THE INVENTION

The present invention relates to shop equipment utilized in a manufacturing operation, and in particular to dies utilized on power operated presses. More specifically, the present invention relates to a structural arrangement for quickly and easily changing the working face of a multiple faced die in the press.

BACKGROUND OF THE INVENTION

It is a typical practice in manufacturing operations to utilize a hydraulically operated or other type of power press with a die carried on its bed to form various types of metal into desired configurations. Frequently the dies are configured with multiple faces which enable the operator to simply reposition the die on the bed rather than remove and replace the die with another die when a different forming operation is desired.

To reposition an elongated die with alternate faces presently requires that the die be lifted above the press bed, rotated into the desired reoriented position and then again lowered onto the press bed.

In the past, such repositioning has been carried out through utilizing detachable hooks connected to pins carried on each end of the hydraulic ram press, with the hooks being in turn connected to pins or other members carried on the multiface die. With the upstroke of the ram, the die would then be lifted off the press bed and the operator, by hand, would rotate the die to position the desired working face beneath the press ram. Then the operator would cause the ram to move towards the press bed to lower the die into its seated position on the bed.

Because multifaced dies generally do not contain a symmetrical mass about their elongate axis, gravity causes them to rotate about their center axis until the heavy portion of the die is beneath the axis. To prevent this rotation, it has been common for the operator and an assistant to utilize a positioning tool as shown in FIG. 4 of this application. As illustrated in FIG. 4, the die is first raised above the bed and the operator and his assistant then rotate the die about its center axis to the proper orientation. At this point, the positioning tool is placed on the top or working die surface so as to hold the die in the desired orientation. Subsequently, the die, which has been lifted by S- or C-hooks or similar support means carried by the hydraulically operated ram, is lowered back onto the bed in its reoriented position.

Nevertheless, it has often been difficult for them to reorient the die to the desired position and maintain it in that position until the tool can be placed on it.

Consequently, a need exists for a means which can simplify the die reorienting procedure, require only one person, and eliminate hand contact with the die which can present potentially dangerous situations should the die mass rotate uncontrollably when suspended above the bed.

SUMMARY OF THE INVENTION

Accordingly, the present invention provides a means which eliminates the need for two men to be used to reorient the die and further eliminates the need for anyone to physically grasp the die to reorient it about its center axis. It further eliminates the potentially hazardous situation which can arise when the mass of the die about its center axis is uneven, tending to rotate the die as it is lifted above the bed.

The present invention, in its preferred form, provides for friction brakes to be carried rigid with pins that are integrally mounted on each end of a multifaced die. The friction brakes are in turn carried by plates which are connectible with the ram through detachable hooks or straps. To retard unwanted rotation of the die as it is lifted from the press bed, the friction brakes are adjusted to exert pressure against the plates. In the present embodiment, the means for quickly and easily adjusting the pressure or friction is provided in the form of hex nut screws.

The plates which carry the friction brakes are supported by brackets which in turn include a pin about which the detachable hooks or straps are placed. A similar pin or shoulder bolt is carried at each end of the press ram for connection with the other end of the C-hook. This hook permits the operator to connect the die with the hydraulic ram quickly and simply lift the die from the bed for reorientation and lower it back onto the bed.

Further provided is a hex hub carried on at least one end of the multiface die. The hub permits the operator to use a specially designed wrench to slowly rotate the die to a different position, that rotation, of course, being made against the friction exerted by the brake on the plates.

With the present invention, one man can adjust the friction which retards rotation of the die so that he can safely and controllably adjust it to a new orientation.

Other advantages and features of the invention will become more fully understood from the following description of the invention and claims, as well as the drawings, a brief description of which follows.

DESCRIPTION OF THE PREFERRED EMBODIMENT

Figure 1:
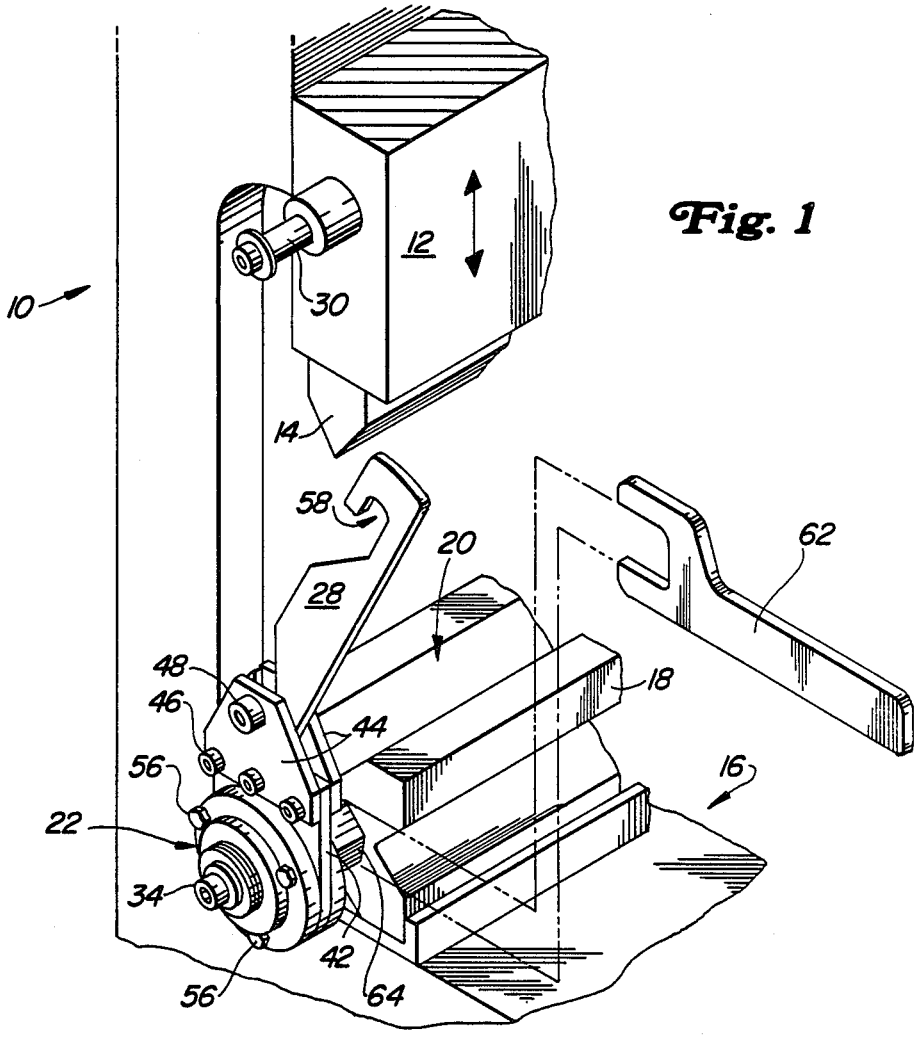
FIG. 1 is a partial pictorial representation of a power press illustrating one end of the ram, the press bed, the die, and the die reorienting mechanism of the present invention.
Figure 4:
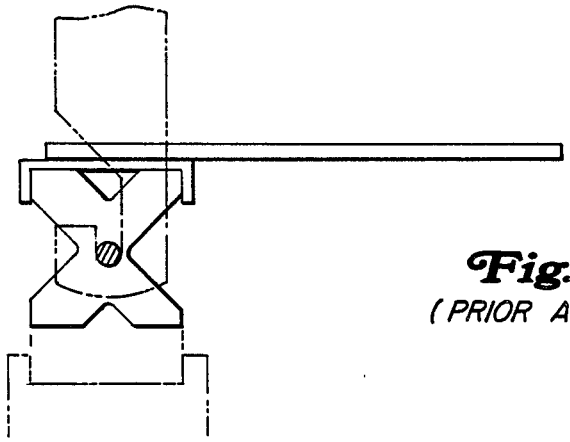
Fig. 4 (PRIOR ART)
FIG. 4 is an illustration of a prior art tool used to reorient a die.

Looking now to FIG. 1, there is illustrated one end of a hydraulic power press 10, including a hydraulically operated ram 12 with a top punch 14. Beneath the ram 12 is carried the press bed 16 upon which is supported the multifaced die 18. Facing upwardly is the working face 20 of the die 18.

Figure 3:
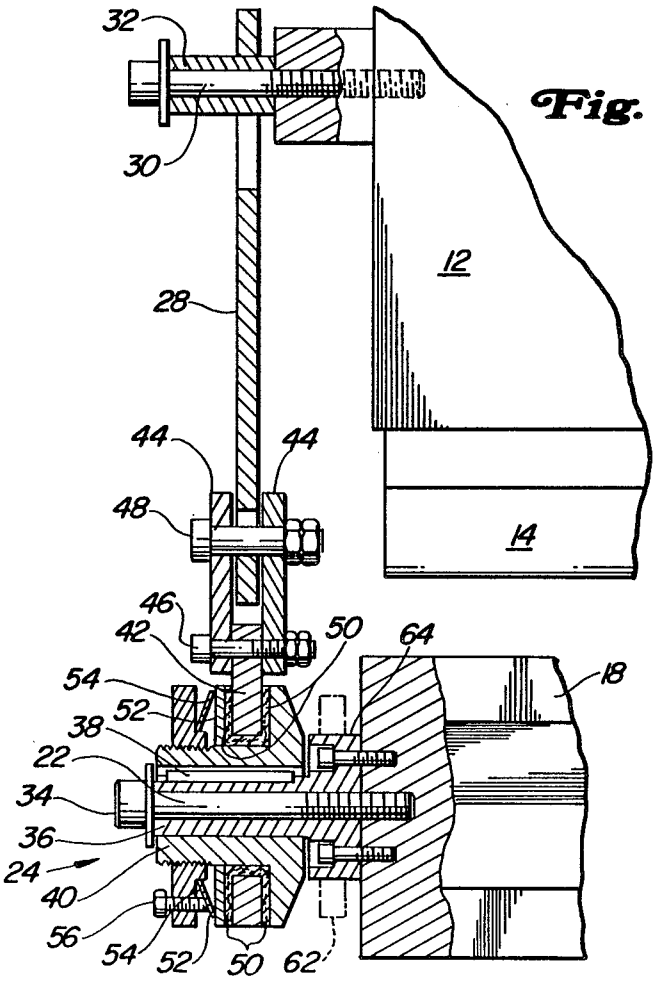
FIG. 3 is a view taken along 3—3 of FIG. 2 illustrating the structure of the die reorienting mechanism.
Figure 2:
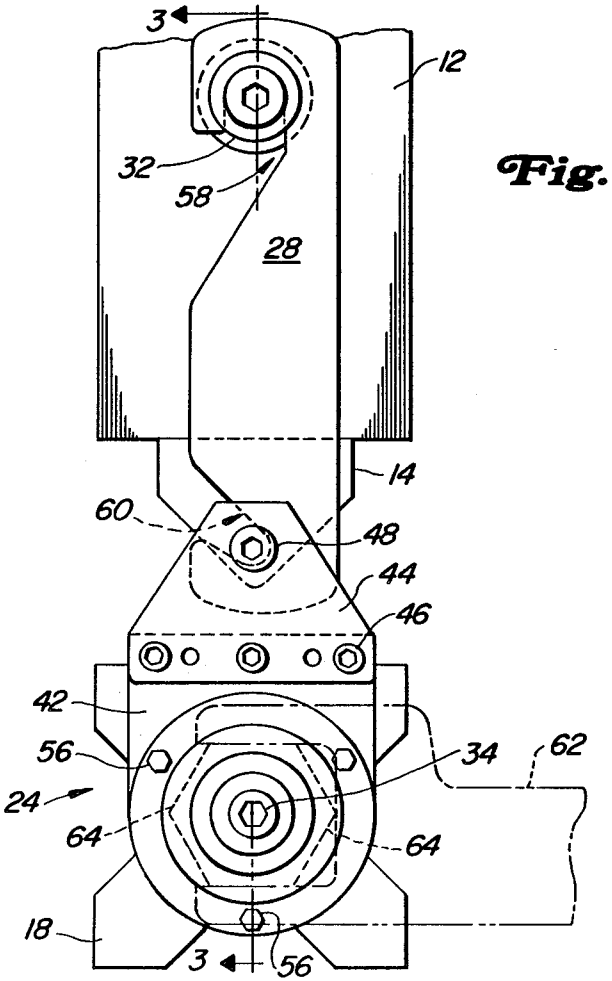
FIG. 2 is an end view of the die reorienting mechanism illustrated in FIG. 1 and showing the die lifted above the bed

Looking now to FIGS. 2 and 3 which illustrate in detail the structural components of the invention, there is connected to the end of the die 18 a shaft 22 mounted into a threaded opening in the end of the die 18. The friction brake 24 in turn is carried by a support means which includes a lifting hook or C-shaped strap 28. For supporting the strap 28, the ram 12 carries in each side portion, projecting transversely therefrom and parallel to the die face 20 a shoulder bolt or pin 30 and sleeve 32. The shoulder bolt 30 is comprised of a threaded pin seated in a drilled and tapped opening of the ram 12.

A similar bolt serves as the shaft 22 which is carried in a drilled and tapped opening of the die 18. This bolt is provided with a hex head 34. Surrounding the bolt 22 is the friction brake 24. In the preferred embodiment illustrated herein, one friction brake found to be acceptable is a Model 500A-1 manufactured by Morse and captioned "Torque Limiter".

An axle 36 surrounds the hex head bolt 22 and carries the brake 24. A key 38 is provided in the axle 36 as well as the brake 24 housing designated 40, to prevent rotation of the brake 24 about the axle 36.

A plate 42 is carried between opposed mounting brackets 44 which in turn are joined by hex head bolts 46. At the top of the brackets 44 is carried a bolt 48 to which can be removably connected with strap 28 in order to lift the die 18.

Plate 42 surrounds the brake 24 and is in face contact on each of its opposite sides with the friction facings 50 of the brake 24. The brake includes a pressure plate 52 carried adjacent the outer friction facing 50 and a disk spring 54 exerts pressure against the pressure plate 52 as defined by changes to the hex adjustment nuts 56.

Hooked openings 58 and 60 are provided in each end of the hook or strap 28 to permit it to be quickly and easily coupled with the mounting plate support pin 48 and the ram shoulder bolt 30. In this way, each multiface die 18 can be equipped with its own adjustable friction brake 24 and a hooked strap 28 can be used to raise the die 18 from the bed 16 and reorient it.

In practice, the invention is utilized as follows:

Each multiface die 18 is equipped at each end with a bolt 22 around which the axle 36 and brake 24 are carried. The friction brake 24 in turn is carried by a plate 42 which is mounted between brackets 44. The brackets carry bolt 48 to which the support hook or strap 28 can be connected.

When the operator wants to position a new die 18 onto the press bed 16, he arranges for the die 18 to be moved onto the press bed 16. He then places the lower hooked portion of the strap 28 about the bolt 48 which supports the friction brake 24. Then lowering the ram 12, he positions the top hooked portion 58 of the strap 28 over the shoulder bolt 30, and raises the ram 12 to lift the die 18 off the press bed 16. If the die faces are of unequal mass so as to cause the die 18 to rotate about its center axis, the operator could use a wrench or a similar tool to adjust the hex nuts 56 that exert pressure on the friction brake disk spring 54, pressure plate 52, and friction facings 50 until rotation of the die 18, bolt 22, axle 36 and friction brake housing 40 is prevented. Once the brake pressure has been adjusted to retard rotation of the die, the operator can position the C-shape wrench 62 on the hex hub 64 carried between the friction brake 24 and die 18 to rotate the die 18 to its desired orientation beneath the ram 12. This rotation would be against the friction exerted by the friction brake 24 and, if the operator had adjusted the friction brake 24 too tightly, those adjustments could be backed off in order to permit the brake 24 to rotate about the plate 42.

Once the friction brake adjustment is properly set, the operator need only connect the strap-hook 28 to the shoulder bolt 30 of the ram 12, raise the die 18, insert the C-shaped wrench 62 over the hex hub 64, reorient the die 18 to position the desired working face beneath the ram 12 and then lower the ram 12 to uncouple the strap-hook 28 from the shoulder bolt 30.

With this adjustment structure, quick and easy changes of the dies are possible, as are quick and easy reorientations of die faces. The help of a second person is avoided and the additional risks to the operator which accompanied reorienting dies by hand are eliminated.

I claim:

1. A die positioning mechanism comprising a bed;

a power operated ram carried above the bed for reciprocal movement towards and away from the bed;

a die carried on the bed and having a first working surface facing the ram, and a second working surface facing away from the ram;

means for repositioning the die so as to orient the first surface to face away from the ram and the second surface to face the ram including:

pin means carried in and extending from each end of the die;

die support means carried by the ram for raising the die from the bed as the ram moves away from the bed; and friction brake means carried on the pin means and selectively connectible to the support means, said brake means being adjustable to limit rotational movement of the die and pin relative to the support means.

2. A die positioning mechanism comprising a bed;

a power operated ram carried above the bed for movement towards and away from the bed;

an elongated multiple faced die carried on the bed for cooperation with the ram, said die having pin means projecting from each of its opposite ends;

and means for repositioning the die so as to orient any of its faces for cooperation with the ram comprising:

support means between the ram and die and selectively connectable there between to raise the die from the bed as the ram moves away from the bed;

adjustable friction brake means between the support means and one pin means for restricting rotative movement of the die and pin means as the die is raised from the bed.

3. A die positioning mechanism comprising a bed;

a power operated ram carried above the bed for movement towards and away from the bed;

an elongated die carried on the bed and having at least two working faces which can be alternately oriented to face the ram and cooperate therewith, each face radially spaced from an axis line extending through the elongated dimension of the die;

means between the ram and die for positioning the die to orient either face towards the ram comprising:

shaft means rigid with and carried on each end of the die and projecting outwardly therefrom;

friction brake means carried around the shaft means and adjustable to retard rotation of the die about its axis;

support means selectively connectable between the ram and the friction brake means for raising the die from the bed as the ram is moved away from the bed.

4. The invention defined in claim 3 wherein the support means includes shoulder bolts spaced apart on the ram and projecting above the bed, and hook means connectable between the bolts and friction brake means.

5. The invention defined in claim 3 wherein the elongated die includes four working faces with the mass of the die being unequally distributed about its axis line.

6. The invention defined in claim 3 wherein the means for positioning further includes a hub portion on the shaft means and a wrench seatable on the hub portion to rotate the die about the shaft and reposition the face oriented for cooperation with the ram.

* * * * *